US010544961B2

(12) United States Patent
Kowald

(10) Patent No.: US 10,544,961 B2
(45) Date of Patent: Jan. 28, 2020

(54) PREMIX BURNER INTERNAL FLUE SHIELD

(71) Applicant: Lennox Industries Inc., Richardson, TX (US)

(72) Inventor: Glenn W. Kowald, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 662 days.

(21) Appl. No.: 15/047,243

(22) Filed: Feb. 18, 2016

(65) Prior Publication Data

US 2017/0241666 A1 Aug. 24, 2017

(51) Int. Cl.
*F24H 3/08* (2006.01)
*F24H 9/00* (2006.01)
*F24H 9/18* (2006.01)

(52) U.S. Cl.
CPC ..... *F24H 3/087* (2013.01); *F24H 9/0073* (2013.01); *F24H 9/1881* (2013.01)

(58) Field of Classification Search
CPC ..... F24H 3/087; F24H 9/1881
USPC ..... 126/99 R, 110 D
See application file for complete search history.

(56) References Cited

U.S. PATENT DOCUMENTS 4,354,479 A 10/1982 Haruhara
6,938,688 B2 * 9/2005 Lengauer, Jr. ..... F24H 3/105 165/170
8,209,971 B2 7/2012 Kalantarifiroozabad et al.
2009/0098496 A1 * 4/2009 Poirier ..... F23C 3/002 431/353
2010/0180368 A1 * 7/2010 West, Jr. ..... A47K 11/023 4/320
2013/0137052 A1 * 5/2013 Laskowski ..... F23N 1/02 431/12
2013/0319347 A1 * 12/2013 Fioriti ..... F24H 1/10 122/13.01
2015/0192291 A1 * 7/2015 Akbarimonfared ..... F23D 14/02 126/116 R
2015/0369495 A1 12/2015 Maricic et al.

* cited by examiner

*Primary Examiner* — Avinash A Savani
*Assistant Examiner* — Aaron H Heyamoto
(74) *Attorney, Agent, or Firm* — Hubbard Johnston, PLLC

(57) ABSTRACT

A flue shield is described for use within HVAC systems and inside of a combustion chamber. The flue shield can be installed around the burner and within the combustion chamber to help dissipate heat that builds up as a result of the combustion of gas and air. Extensions from the flue shield extend through holes in the combustion chamber and into tubes of a heat exchanger. An air gap is created between the flue shield and the inner surfaces of the combustion chamber and heat exchanger tubes. Installation of a flue shield provides better efficiency than insulation solutions, reduces stresses on the heat exchanger, and provides safety benefits.

10 Claims, 7 Drawing Sheets

PREMIX BURNER INTERNAL FLUE SHIELD

TECHNICAL FIELD

The present disclosure is directed to HVAC systems and more particularly to a combustion chamber in a low NOx heating system.

BACKGROUND OF THE INVENTION

HVAC systems typically contain a heat exchanger that houses a combustion of a gas and air mixer. Typically, air and gas are mixed and ignited within a combustion chamber. Flames from the combustion heat the combustion chamber and may also extend out of the combustion chamber into heat exchanger tubes or clamshells. Air may be blown past the tubes or clamshells in order to be heated. The combustion creates high temperatures within the combustion chamber and the tubes/clamshell. The combustion of gases within HVAC systems can result in very high temperatures. The high temperatures can cause stresses on the burner and heat exchanger components due to the high temperatures. There can also be safety or fire risks when components are raised to such high temperatures.

In order to reduce pollutants some HVAC systems implement low nitrous oxide burners and heat exchangers. One typical low NOx system comprises a premixer and/or premix burner. These components mix gas and air prior to combustion in the combustion chamber. Such systems results in higher temperatures than normal systems, in some embodiments up to around 1300 F. With such high temperatures, combustion chambers and heat exchangers can be subject to great stresses, especially in regions between areas of differing temperatures. One solution in the prior art has been to add insulation within the burner. Insulation helps lower temperatures on the surface of HVAC components, but insulation can also direct the heat to different locations within a burner or heat exchanger, merely relocating problems to different locations. Some insulations can also be environmentally damaging.

BRIEF SUMMARY OF THE INVENTION

One embodiment of the present disclosure comprises a heat exchanger comprising: a burner, the burner operable to receive a mixture of gas and air; a combustion chamber, the combustion chamber operable to house an igniter and the burner, wherein the igniter ignites the mixture and the combustion chamber is operable to house the combustion of the mixture, the combustion chamber comprising a plurality of holes; a flue shield, the flue shield operable to fit within the combustion chamber and surround the combustion of the mixture and create an air gap between an inner surface of the combustion chamber and an outer surface of the flue shield, the flue shield comprising a second plurality of holes; and one or more heat exchanger inlets, each of the heat exchanger inlets operable to receive the combustion of the mixture through the first and second plurality of holes.

Another embodiment of the present disclosure comprises a flue shield for a heat exchanger comprising: a combustion shield, the combustion shield operable to attach to a burner and house a combustion of a gas and air mixture and operable to fit within a combustion chamber, the combustion shield further operable to form an air gap between its outer surface and the inner surface of the combustion chamber; and a plurality of extensions operable to extend from the combustion shield and protrude through a plurality of holes in the combustion chamber and into a plurality of inlets in a heat exchanger, wherein the plurality of extensions direct the combustion into the plurality of inlets.

Another embodiment of the present disclosure comprises a method of manufacturing a heat exchanger comprising: providing a premixer, the premixer operable to mix gas and air; providing a burner, the burner operable to receive a gas and air mixture from the premixer and to ignite the gas and air mixture; providing a combustion chamber, the combustion chamber operable to attach to the burner and to house a combustion of the gas and air mixture, the combustion chamber comprising a plurality of holes; providing a flue shield, the flue shield operable to fit within the combustion chamber and surround the combustion of the mixture, and further operable to create an air gap between an inner surface of the combustion chamber and an outer surface of the flue shield, the flue shield comprising a plurality of extensions operable to extend through the plurality of holes; and providing a plurality of heat exchanger inlets, the plurality of heat exchanger inlets operable to receive the plurality of extensions therein, wherein the plurality of extensions direct the combustion into the plurality of heat exchanger inlets.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The present disclosure includes teachings directed to a flue shield for use inside a combustion chamber in an HVAC system. The flue shields helps to dissipate heat, lower the surface temperature of system components, and to do so in a more efficient manner than prior art solutions such as insulation. The flue shield can be constructed of readily available materials and in some cases can be retrofitted to preexisting HVAC systems.

Figure 1:
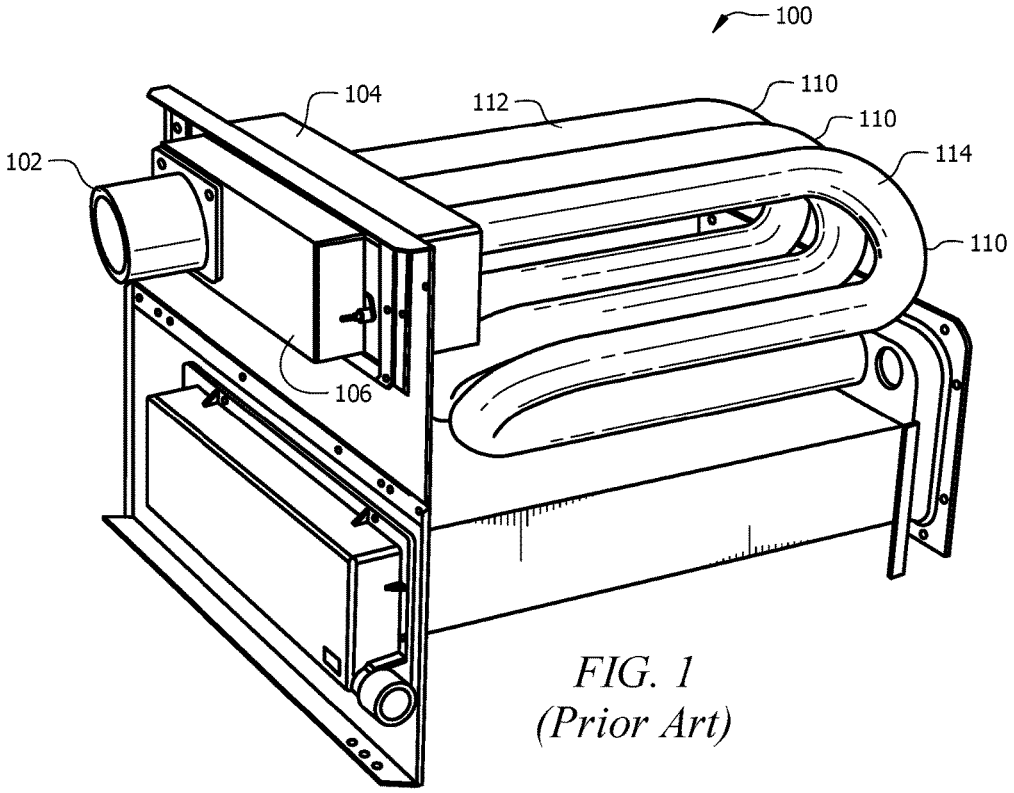
FIG. 1 (Prior Art)
FIG. 1 is a diagram of a prior art embodiment.

FIG. 1 shows an embodiment of a prior art burner and heat exchanger. Gas-air inlet 102 delivers a mix of gas and air to pre-mix burner assembly 106. The mixture passes through burner assembly 106 into combustion chamber 104 where an igniter (not shown) can ignite the mixture. The combusted mix of gas and air and particulates then passes into heat exchanger tubes 110. Temperatures within the combustion chamber 104 and heat exchanger tubes 110 (especially areas proximate 112 the combustion chamber 104) can reach 1300 F, or similar temperatures depending on the particular HVAC system. To help control temperatures within the system, a prior art solution for use with premix burners is to place insulation within the interior of the combustion chamber and/or heat exchanger tubes. The insulation can comprise various types, such as refractory ceramic fiber. The insulation is typically formed along the inside surface of the combustion chamber and thereby encases the combustion of any materials therein. Insulation can help to reduce temperatures in certain areas but can raise them in other areas. For instance, insulation within the combustion chamber 104 or area 112 proximate the combustion chamber 104 can cause the heat of the system to be redirected to less proximate area 114. As a result, any stresses that the high temperatures cause, will be directed at area 114 instead of area 112. But the heat exchanger tubes 110 still face high temperature stresses. Generally, the use of insulation results in reduced efficiency and excessive heat exchanger temperatures further down in the heat train. High temperature insulations are also expensive, difficult to handle, and have a current classification as a possible human carcinogen.

Figure 2:
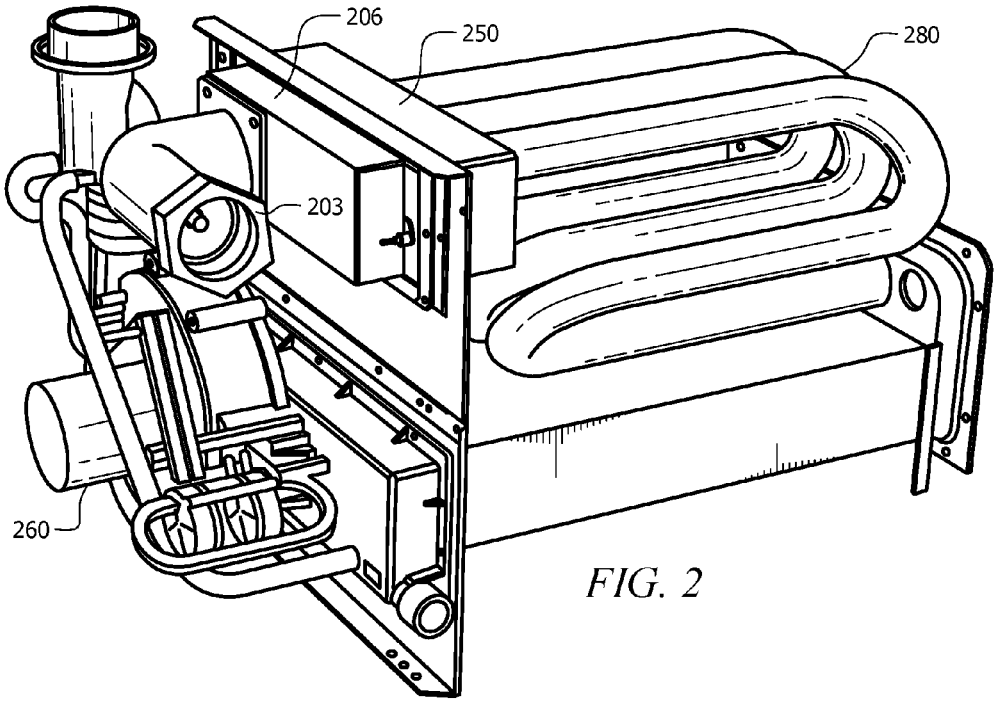
FIG. 2 is a diagram of a system embodiment of the present disclosure.

FIG. 2 displays an embodiment of the interior of an HVAC cabinet under the present disclosure. Inlet 203 provides gas and air to a premix burner assembly 206. Combustion chamber 250 encloses an igniter and flue shield (not shown). Combustion within the combustion chamber 250 provides combusted material and flames which can reach into tubes 280. A blower 260 induces flow of combustion products through tubes 280 and through the remaining components in the heat exchanger. Other components are similar to other heat exchangers and HVAC units well known in the art.

Figure 3:
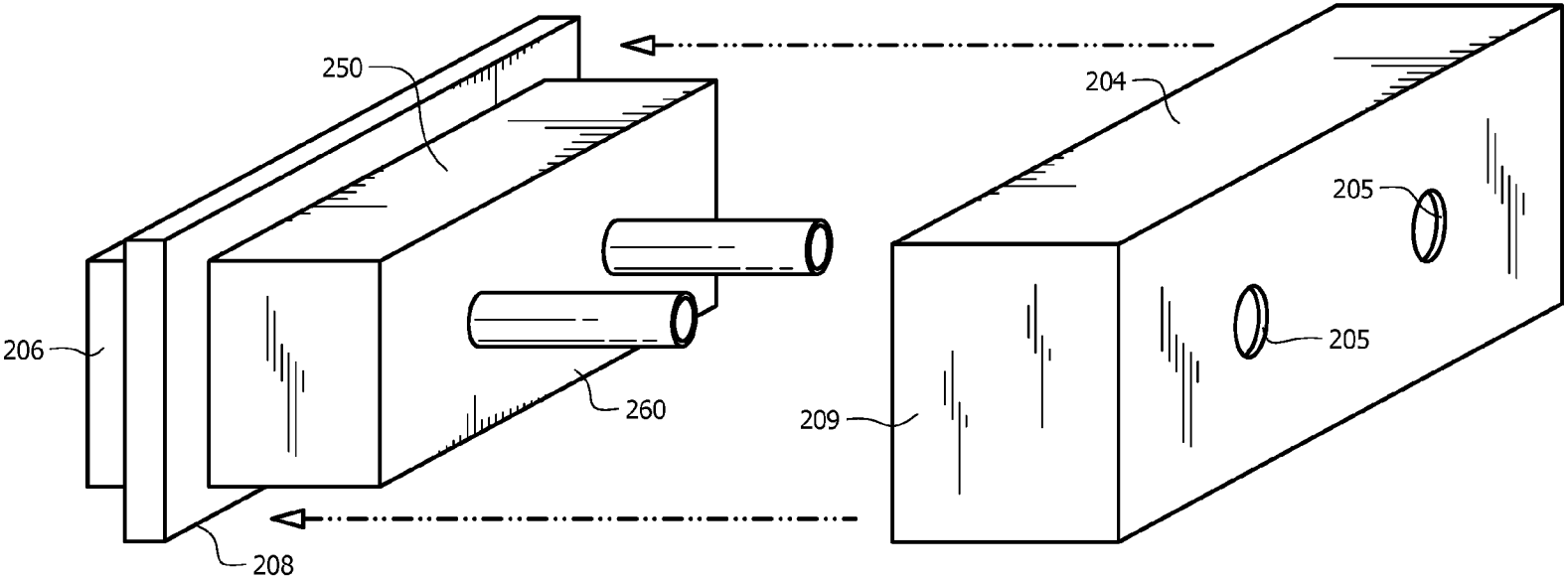
FIG. 3 is a diagram of a system embodiment of the present disclosure.

FIG. 3 displays a more detailed view of a flue shield embodiment in FIG. 2 under the present disclosure. As shown, flue shield 250 can be installed inside a combustion chamber 204. Pre-mix burner 206 delivers air and gas to the interior of the flue shield 250 where an igniter (not shown) ignites the mixture. Flue shield 250 is placed beneath/inside the combustion chamber 204 so that the body 209 of combustion chamber 204 is flush against face 208. Flue shield extensions 260 extend through combustion chamber holes 205. Extensions 260 can then extend into heat exchanger tubes (not shown). Other embodiments may not utilize extensions 260. The dimensions of the flue shield 250, combustion chamber 204, and flue shield extensions 260 should be such as to leave an air gap between combustion chamber 204 and flue shield 250. There will also be an air gap between the surface of the extensions 260 and the inner surface of a heat exchanger. The dimensions of the air gaps can be chosen depending on the particular embodiment. Some embodiments may use almost an interference fit in various parts of the system, such as the extensions 260, or some embodiments may use quite large air space between the various components. The application of a flue shield not only solves the problem of excessive temperatures but also continues to provide radiant and convective heat transfer. This helps maintain efficiency and cools flue gases to the point where heat exchanger temperatures are manageable downstream of the internal shielding. The internal flue shielding can be manufactured with conventional material and methods and eliminates the use of potentially hazardous materials. Flue shield 250 and combustion chamber 204 can attach to face 208 in any manner appropriate including welding, soldering, and other means well known in the art.

Figure 4:
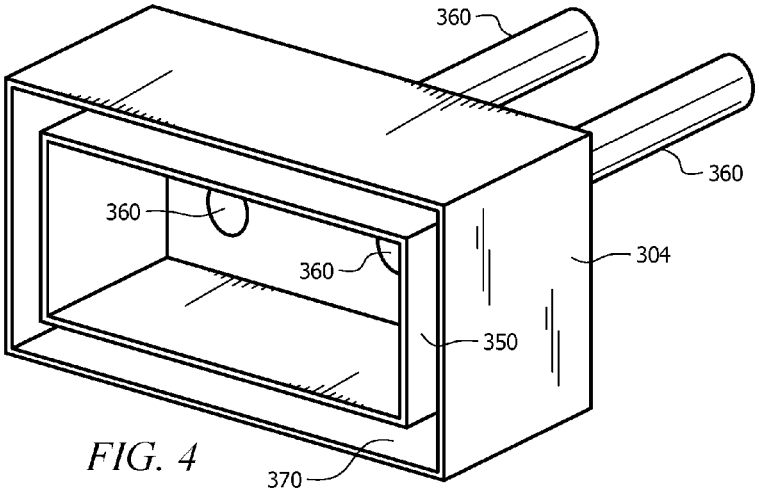
FIG. 4 is a diagram of a system embodiment of the present disclosure.

FIG. 4 depicts another view of an embodiment of a flue shield under the current disclosure. In this view the burner-facing side of flue shield 350 and combustion chamber 304 are seen. Flue shield extensions 360 extend into combustion chamber holes 305 toward heat exchanger tubes (not shown). As can be seen, when installed, the flue shield 350 creates an air gap 370 between itself and the edges of the combustion chamber 304. The embodiment shown helps to lower the surface temperature of the combustion chamber 304 and of the heat exchanger tubes (not shown).

Figure 5:
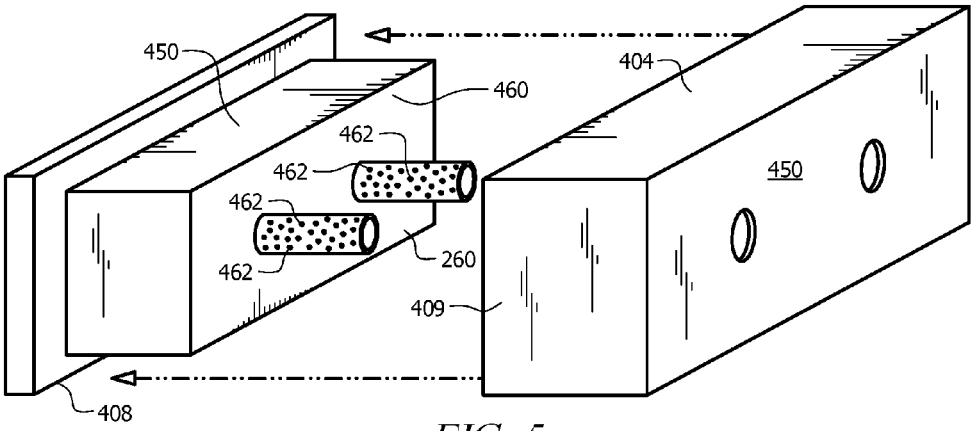
FIG. 5 is a diagram of a system embodiment of the present disclosure.

FIG. 5 shows an embodiment wherein the flue shield extensions comprise a plurality of holes along their length. As shown, flue shield 450 attaches to a burner surface 408. Flue shield extensions 460 are attached to the flue shield 450 and comprise a plurality of holes 462. Holes 462 can allow for cooling of the combusted material and flame from the burner along a greater length of extensions 462. In other embodiments, such as FIG. 3, the hot temperature of the combusted material and flame may only escape the extensions 260 at the open end. In the embodiment of FIG. 4, heat may be dispersed along the entire length of extensions 462. Flue shield 450 and flue shield extensions 460 can be covered by combustion chamber 404 and chamber holes 405.

Figure 6:
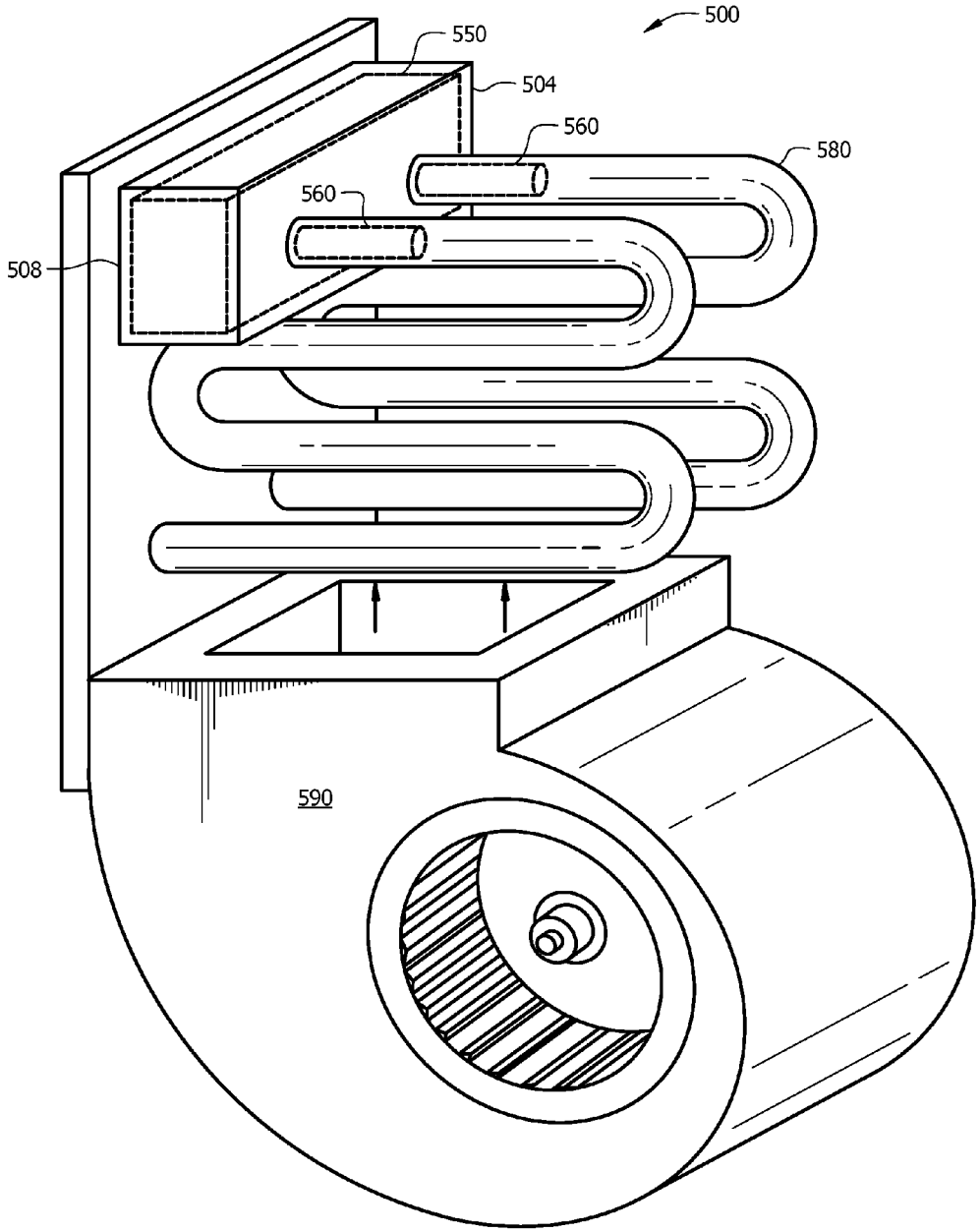
FIG. 6 is a diagram of a system embodiment of the present disclosure.

FIG. 6 displays an embodiment of an HVAC system and heat exchanger 500 utilizing the present disclosure. Flue shield 550 attaches to face 508 and fits within combustion chamber 504 (also attached to face 508). Flue shield extensions 560 extend through holes in the combustion chamber and into heat exchanger tubes 580. A blower 590 can sit below the tubes 580. In this embodiment tubes are shown in the heat exchanger 500. However, other embodiments can use clamshells or other types of heat exchanger tubes or geometries.

Figure 7:
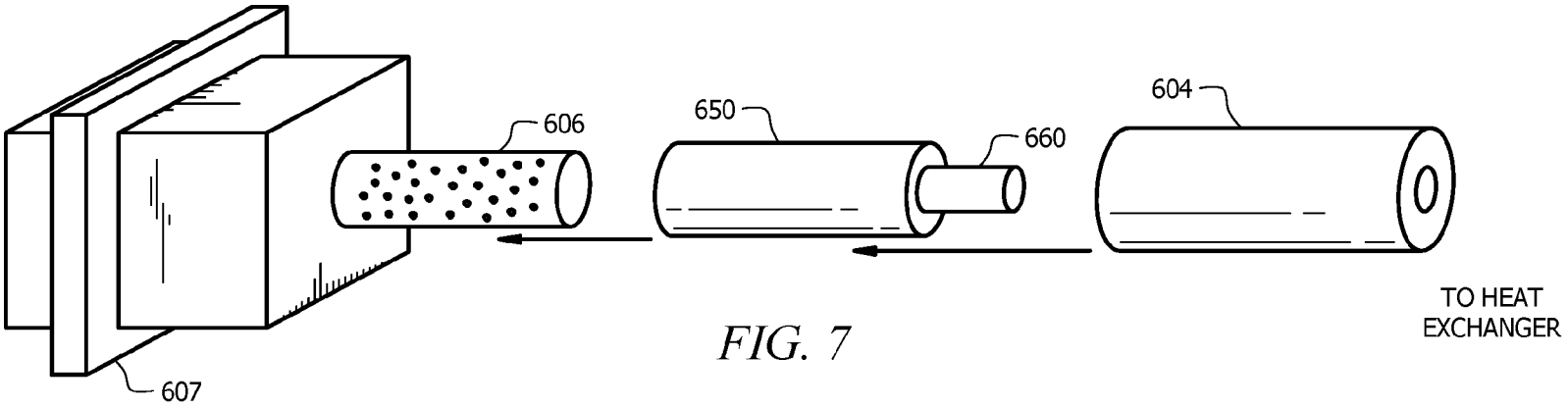
FIG. 7 is a diagram of a system embodiment of the present disclosure.

The geometries and shapes of a burner, heat exchanger and flue shield can vary depending on a user's desires or wishes. FIG. 7, for example, displays an embodiment of the present disclosure in a setup with a cylinder burner 606. In such an embodiment, flue shield 650 can take a cylinder shape. Other components, such as a premix 607 can be similar to other embodiments. The flue shield 650 of this embodiment can work by the same principles of other differently shaped embodiments. An air gap created between the flue shield 650 and the combustion chamber 604 helps to contain the high temperatures within the flue shield 650 and prevents the exterior of the combustion chamber 604 and other components from being overheated. Flue shield extension 660 extends through combustion chamber hole 605, and can then extend into a heat exchanger.

Figure 8:
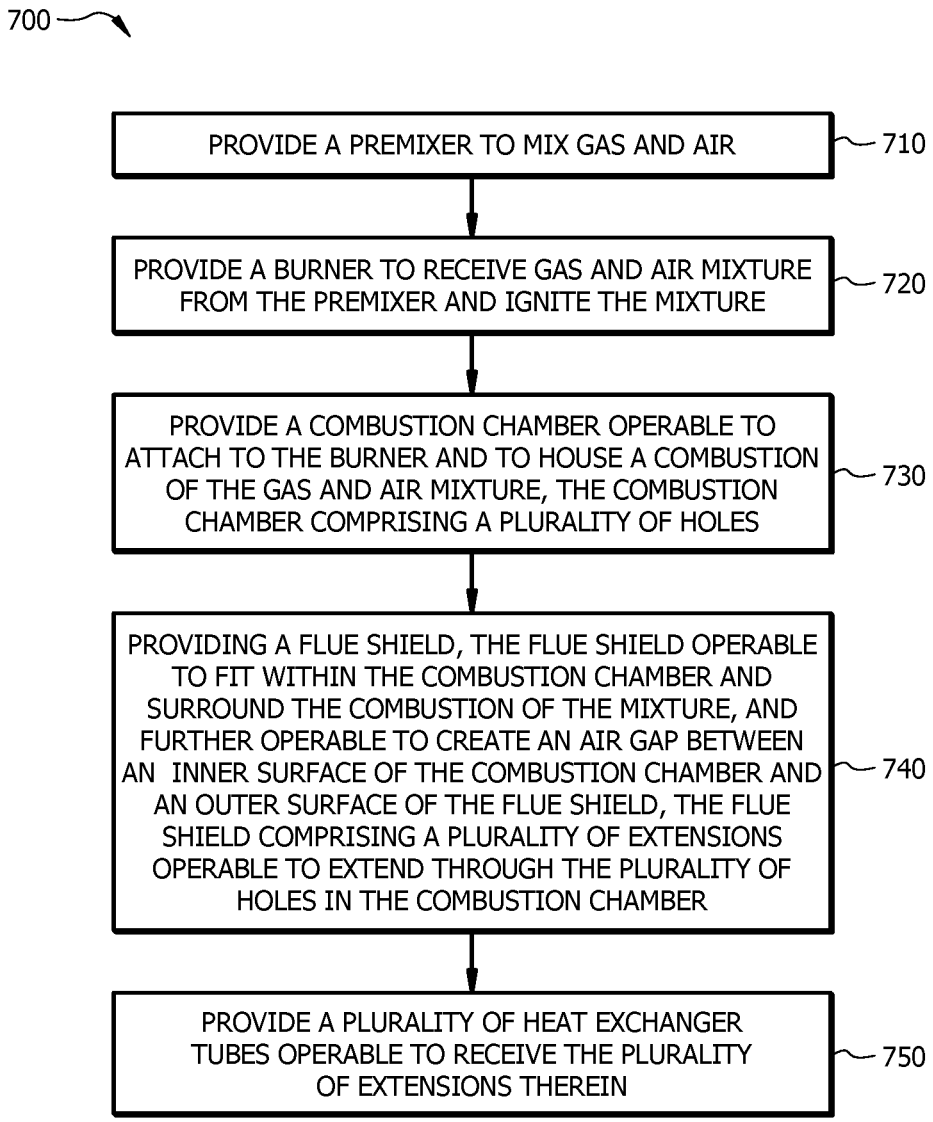
FIG. 8 is a flow-chart diagram of a method embodiment of the present disclosure.

FIG. 8 displays a method embodiment 700 of the present disclosure. At step 710 a premixer is provided that is operable to mix gas and air. At step 720 a burner is provided that is operable to receive a gas and air mixture from the premixer and to ignite the gas and air mixture. At step 730 a flue shield is provided that is operable to attach to the burner and to house the combustion of the gas and air mixture, the flue shield comprising a plurality of extensions. At step 740 a combustion chamber is provided that is operable to attach to the burner and to house the flue shield and create an air gap between the combustion chamber and the flue shield, the combustion chamber comprising a plurality of holes operable to receive the plurality of extensions therethrough. At step 750 a plurality of heat exchanger tubes are provided that are operable to receive the plurality of extensions therein.

Embodiments of a flue shield as described herein can comprise a variety of materials. In a preferred embodiment a flue shield is made of stainless steel. Different stainless steels can be used such as 400 series, 300 series or other alloys of chromium, nickel and other metals as appropriate. Some embodiments may be able to use ceramics. A typical embodiment of a flue shield may have to withstand temperatures up to 1300 F. Some ceramics can be made to withstand such temperatures or higher and may be appropriate for certain flue shield embodiments.

Experiments performed using a flue shield as described herein has shown that a flue shield can cause a drop in external temperature of the combustion chamber and heat exchanger tubes from roughly 1300 F to 1100 F in components of a heat exchanger and combustion chamber. Other embodiments have produced similar results. A temperature drop of approximately 15-20% is commonly seen. However, embodiments can produce greater or less temperature difference depending on various factors such as size, geometry, type of burner, materials used and other factors.

Common manufacturing processes can be used to create flue shields according to the present disclosure. Welding can attach extensions onto a flue shield and welding can also attach flue shields to burners and other components. Bolts and other physical attachment means can also be used. Various manufacturing processes for stainless steel and other metals, well known in the art, can be used to create flue shields. If a flue shield is comprised of ceramic then ceramic manufacturing processes will have to be used. Various attachment means such as bolts, screws, sealants and other means can be used when attaching ceramic flue shields to other components. Ceramic flue shields will likely have to be created in one piece comprising both extensions and the flue shield body. Metal flue shields can be manufactured of separate pieces—body and extensions. The body and extensions can then be welded or soldered together or connected by other means.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A heat exchanger comprising:

a burner configured to receive a mixture of gas and air;

a combustion chamber comprising a first plurality of holes, , wherein the first plurality of holes comprises a first exit hole and a second exit hole, the combustion chamber configured to:

house an igniter and the burner, wherein the igniter ignites the mixture, and house the combustion of the mixture;

a flue shield comprising a second plurality of holes, the flue shield configured to:

fit within the combustion chamber, be surrounded by the combustion of the mixture, create an air gap between an inner surface of the combustion chamber and an outer surface of the flue shield;

wherein the flue shield is within the combustion chamber;

one or more heat exchanger inlets, each of the heat exchanger inlets configured to receive the combustion of the mixture through the first and second plurality of holes; and wherein the flue shield further comprises a plurality of flue shield extensions including at least a first flue shield extension and a second flue shield extension, and wherein the first flue shield extension extends from the flue shield through the first exit hole of the combustion chamber and the second flue shield extension extends from the flue shield through the second exit hole of the combustion chamber.

2. The heat exchanger of claim 1 wherein the plurality of flue shield extensions is configured to extend into the heat exchanger inlets.

3. The heat exchanger of claim 2 wherein the plurality of extensions comprise a third plurality of holes along the length of each of the plurality of extensions.

4. The heat exchanger of claim 1 wherein the heat exchanger comprises a cylinder-shaped burner.

5. The heat exchanger of claim 1 wherein the flue shield comprises stainless steel.

6. The heat exchanger of claim 1 wherein the flue shield comprises ceramic.

7. The heat exchanger of claim 1 wherein the plurality of heat exchanger inlets comprise a plurality of clamshell heat exchangers.

8. The heat exchanger of claim 1 further comprising a blower.

9. A heat exchanger assembly comprising:

a combustion chamber having an interior volume and formed with at least a first exit hole formed on an combustion-chamber exit wall and a second exit hole formed on the combustion-chamber exit wall;

a flue shield disposed within the interior combustion-chamber volume of the combustion chamber, wherein the flue shield has an interior flue-shield volume and at least a first exit hole and a second exit hole formed on an exit wall of the flue shield;

a first flue-shield extension and a second flue-shield extension, wherein the first flue-shield extension extends from the first exit hole of the flue shield through the first exit hole of the combustion chamber, and wherein the second flue-shield extension extends from the second exit hole of the flue shield through the second exit hole of the combustion chamber; and a plurality of heat exchange tubes fluidly coupled to the combustion chamber, wherein the first flue-shield extension and the second flue-shield extension extend at least partially into the plurality of heat exchange tubes.

10. The heat exchanger assembly of claim 9, wherein the first flue-shield extension has longitudinal body and the second flue-shield extension has a longitudinal body, and further comprising a plurality holes formed along the longitudinal body of the first flue-shield extension and a plurality holes formed along the longitudinal body of the second flue-shield extension.

* * * * *